United States Patent [19]

Moussa

[11] Patent Number: 4,573,870

[45] Date of Patent: Mar. 4, 1986

[54] SOLID TURBINE WHEEL WITH GUIDED DISCHARGE

[75] Inventor: Zaher M. Moussa, Greensburg, Pa.

[73] Assignee: Elliott Turbomachinery Co., Inc., Jeannette, Pa.

[21] Appl. No.: 665,246

[22] Filed: Oct. 26, 1984

[51] Int. Cl.[4] ..... F01D 1/02

[52] U.S. Cl. ..... 415/202; 415/212 R; 415/56

[58] Field of Search ..... 415/202, 212 R, 52, 415/56, 59, 81, 117, 143, 62

[56] References Cited

U.S. PATENT DOCUMENTS

| | | | |
|---|---|---|---|
| 298,477 | 5/1884 | Kellams | 415/185 |
| 812,795 | 2/1906 | Keller | 415/202 |
| 827,165 | 7/1906 | Mariner | 415/202 |
| 845,059 | 2/1907 | Dake | 415/202 |
| 928,178 | 7/1909 | Burnfield | 415/202 |
| 1,038,972 | 9/1912 | Sanders | 415/56 |
| 1,625,433 | 4/1927 | Schmidt | 415/56 |
| 4,027,995 | 6/1977 | Berry | 415/92 |
| 4,347,034 | 8/1982 | Vigh | 415/202 |
| 4,421,454 | 12/1983 | Wosika | 415/117 |
| 4,435,121 | 3/1984 | Wosika | 415/202 |
| 4,502,838 | 3/1985 | Miller et al. | 415/202 |

*Primary Examiner*—Edward K. Look
*Assistant Examiner*—John Kwon
*Attorney, Agent, or Firm*—Robert P. Hayter

[57] ABSTRACT

A solid wheel turbine including a series of spaced overlapping buckets suitable for use in high quality and wet steam applications is disclosed. Complex flow passageways for buckets in a turbine wheel are utilized to achieve both high erosion resistance and improved performance by guiding the discharge from the bucket. The solid turbine wheel has a reduced diameter rim portion and a full diameter rim portion such that the flow passageway may change in the relative radial displacement between the inlet and the discharge. An L-shaped passageway extending from the reduced diameter portion to the full diameter portion is utilized to obtain additional guidance of the flow as it is discharged from the turbine wheel to obtain improved performance.

10 Claims, 10 Drawing Figures

SOLID TURBINE WHEEL WITH GUIDED DISCHARGE

BACKGROUND OF THE INVENTION

This invention relates to a solid wheel turbine having a bucket machined into the perimeter of the wheel. The invention further concerns using a wheel of different diameters such that the discharge flow from the turbine may be guided for an efficiency improvement.

The buckets or blades of turbines are subject to wear or erosion due to a number of factors. In a steam turbine prime mover, for example, the kinetic energy that is absorbed from the steam by the moving blades or buckets and delivered as shaft work to the device being driven results from the expansion of steam into the two-phase region resulting in a lowering in the quality of the steam. As the moisture content rises with the lowering of steam quality, the buckets or blades become more susceptible to erosion. Although wet steam is generally associated with the last stages of a condensing steam turbine, energy recovery from process steam and the advent of geothermal power have resulted in the initial supplying of wet steam, (20–30% quality for geothermal steam and 80% quality for oil well steam injection.) In addition to the presence of water droplets, blade erosion is also a function of the velocity and impingement angle of the moisture particles. The presence of particulates in gases has a similar effect to the presence of water droplets. One solution to blade erosion is the use of replaceable blades.

In U.S. patent application Ser. No. 390,604 filed June 21, 1982 entitled "Solid Wheel Turbine" now abandoned there is disclosed a single or multistage solid wheel turbine having a bucket machined into the perimeter of the wheel. Although this turbine upon testing was found to be suitable for its intended purpose it was ascertained that improvement in efficiency could be obtained by providing additional guidance to the working fluid at the discharge portion of the bucket. The subject matter of this patent application was developed in response thereto and has resulted in a significant improvement in performance. By providing a solid wheel turbine having two sections of different diameters it is possible to divert the high quality steam from the generally half U-shaped bucket into a portion of the wheel defining an L-shaped passageway extending generally radially outward from the U-shaped passageway. In this manner the steam and contaminants being discharged from the bucket are guided outwardly and away from the inlet passage.

This solid wheel turbine retains the advantages of the device disclosed in U.S. patent application Ser. No. 390,604 now abandoned. The present device is capable of very high tip speeds depending upon the type of design and the material used. This turbine is more efficient than a conventional axial flow turbine. This turbine is at least as efficient as a radial inflow turbine, when relatively small power is needed from a relatively high heat drop application, since it has much lower operating rotating speed and therefore incurs smaller, mechanical losses when connected to the device to be driven. The nozzle ring construction is of the radial inflow type with converging or expanding nozzles and low incidence angles for maximizing performance. Because of the bucket geometry and the tangential inflow from the nozzles, moisture droplets or solid particulates moving slower than the gas flow will impinge upon the buckets at low angles and low relative velocity greatly reducing erosion and minimizing braking losses. The inlet and exhaust casings are simply constructed to enable partial-to-full admission of motive fluid at very high pressures. Since the turbine wheel has buckets machined directly into it, bucket failures are essentially impossible. Furthermore, because of the inherent geometrical configuration of the buckets in relation to the disk, induced vibration is virtually eliminated. Integral rotor or thru-bolt construction may be used. With this rugged construction the present invention is suitable for a wide range of gases, either superheated or saturated. By using an appropriate gear reduction unit any output shaft speed is obtainable at optimum turbine efficiency.

Since the herein described turbine wheel has two portions of varying diameters, it is possible to either manufacture the wheel as a single element and thereafter machine the passages into the wheel or the wheel may be manufactured as two cylindrical portions each being machined with the appropriate structure and then the two being combined to form the turbine wheel.

SUMMARY OF THE INVENTION

It is an object of the present invention to provide a solid wheel turbine.

It is a further object of the present invention to provide a turbine wheel having high moisture and particulate erosion resistance, low windage and low thrust capability.

It is another object of this invention to provide a radial admission turbine which is more efficient than a conventional axial flow turbine and at least as efficient overall as a radial inflow turbine at low horsepower.

It is a further object of this invention to provide a turbine suitable for use with wet steam and dirty gases.

It is a still further object of the present invention to provide a turbine having guided discharge for improved performance.

It is a yet further object of the present invention to provide a solid wheel turbine having portions of differing diameters such that the erosion advantages of an earlier design may be combined with the improved efficiency of guided discharge from the solid turbine wheel.

Another object of the invention is to provide a safe, economical, and reliable, solid wheel turbine for appropriate uses.

These and other objects of the present invention are achieved according to a preferred embodiment of the turbine by providing a nearly impulse turbine having an inlet and an outlet with a flow path therebetween, with a nozzle ring and a turbine wheel. The turbine wheel includes first and second circumferential rim portions of varying diameters each of a predetermined width with a plurality of uniformly-spaced, overlapping buckets formed around said rim portion. Each of the buckets defines a generally first half U-shaped passage having a leg portion and a curved portion connected to the leg portion, a second half U-shaped passage joined to the first half U-shaped passage and an L-shaped passage extending at an angle from the second half U-shaped passage to the second rim portion and said leg portion of the first U-shaped passage extending to the first rim portion of the wheel. These two half U-shaped portions are generally arranged in planes perpendicular to each other. A solid center portion defines passageways of the adjacent buckets and labyrinth sealing means circumferentially extend about said rim portion and coact with said center portions to provide a fluid seal between said leg portion which defines an inlet fluid path and the L-shaped portion which defines an outlet fluid path.

Additionally disclosed is a turbine wheel including a solid wheel having a full diameter, circumferential rim portion and a reduced diameter of circumferential rim portion each of a predetermined width, said wheel defining a plurality of uniformly spaced overlapping buckets formed within said wheel around the circumferential rim portions. Each of said buckets defines a first half U-shaped passage having a leg portion connected to a curved portion with said curved portion having a diameter less than the width of the wheel and said leg portion being generally parallel to a radially extending side surface of the wheel and extending to the reduced diameter rim portion of the wheel. Each of said buckets additionally defines a second half U-shaped passage connected to the curved portion of the first half U-shaped passage and a generally L-shaped passage extending generally radially outward from the second half U-shaped passage and terminating at the full diameter rim portion

DESCRIPTION OF THE PREFERRED EMBODIMENT

The invention will be described herein with reference to a single stage turbine having particular inlet and outlet flow paths. It is to be understood by those skilled in the art that the invention will also be applicable to multistage turbines, turbines having different inlet and outlet flow paths and turbines involving different types of support structures for the turbine wheel.

Figure 1:
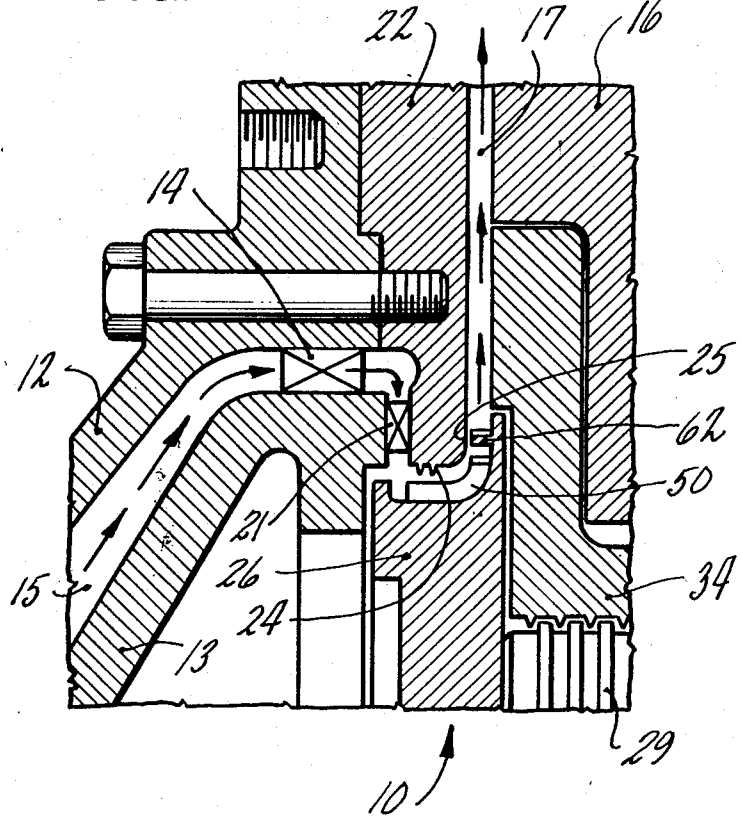
FIG. 1 is a partial, sectional view of a single stage solid wheel rotor mounted within a turbine.

FIG. 1 is a partial sectional view of the turbine rotor mounted within a solid wheel, single stage turbine 10. A portion of rotor 26 connected to shaft 29 is shown. Turbine 10 includes axial inlet casing 12 and a nose cone 13 defining an inlet flow path 15 therebetween. Inlet guide vanes 14 are shown located within inlet flow path 15 for controlling the flow angle of mixture to the blades of nozzle ring 21. Nozzle blades 21 of the nozzle ring are shown mounted between nose cone 13 and nozzle support 22 to direct steam into the bucket at the appropriate angle. Outlet 17 is formed between nozzle support 22 and exhaust volute casing 16 shown for guiding steam being discharged from rotor 26. Bucket 50 is shown in sectional view similar to FIG. 2 at the periphery of rotor 26. Additionally it may be seen that nozzle support 22 has a labyrinth seal 24 mounted at the end thereof which acts with the surfaces defining the buckets to provide a seal between the inlet and outlet of the bucket. Additionally side wall sealing surface 25 of nozzle support 22 extends adjacent flow divider 62 located between the discharge areas of adjacent buckets such that a seal is formed along the radially outward extending edge of the discharge area of the bucket to complete the delineation of the discharge flow path from the bucket.

Seal ring 34 is shown mounted adjacent the shaft and rotor and contains a seal for preventing gas flow along the shaft as well as defining a portion of the outlet flow path for the steam.

Referring now to the specific figures detailing the complex configuration of the buckets machined into the turbine wheel, it may be seen from the various sectional views and the perspective view that the bucket is made up of several passageways. A first half U-shaped passageway 55 is formed at the inlet 52 to the bucket and includes a leg portion 57 extending generally parallel to side wall 27 of the rotor and a curved portion 58 which generally diverts the passage about a 90° angle from the inlet portion. It is the leg portion and the curved portions which make up the half U-shaped passage which are formed in the reduced diameter rim portion 28 of the rotor and are substantially the same as the turbine disclosed in U.S. patent application Ser. No. 390,604.

However, connected in series to the half U-shaped passageway are second half U-shaped passageway 53 and L-shaped passageway 59. The L-shaped passageway extends radially outwardly from the second half U-shaped passageway and further acts to divert the steam both upwardly and to the rear as it exists through discharge 54. It is this additional passageway that provides the geometry for guiding the discharge flow of steam from the turbine wheel that results in the significantly improved efficiency over the previous turbine wheels. The second half U-shaped passageway receives the flow from the first half U-shaped passageway in a generally axial direction and diverts the flow in a generally outward radial direction and delivers the flow to the L-shaped passageway.

Figure 2:
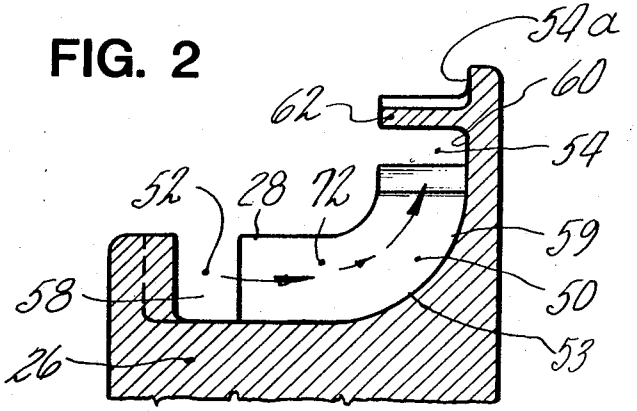
FIG. 2 is a sectional view of the rotor taken at line II—II from FIG. 4.
Figure 4:
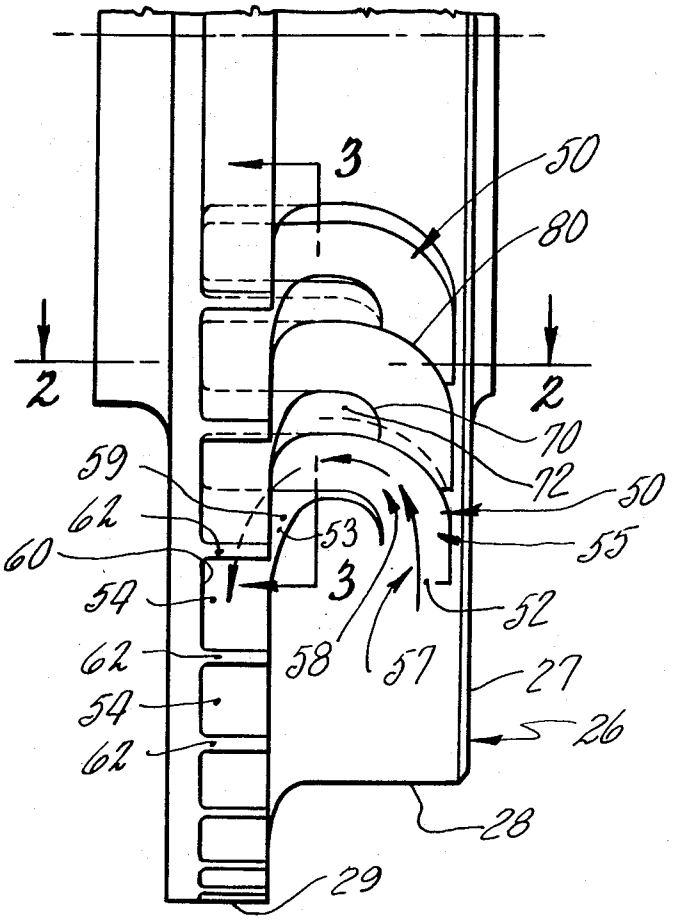
FIG. 4 is a partial end view of the rotor.

Referring specifically to FIG. 2 which is a cross-sectional view of the turbine wheel taken at line II—II in FIG. 4, a sectional view of the bucket may be seen. Arrows are shown for indicating the direction of flow. Bucket 50 is defined as a passage by various surfaces. A Contour 2 referenced by the numeral 70 defines the inner radius surface defining the narrow diameter portion of the solid center portion 72 formed between buckets whose continuation is flow divider 62. It may be seen that the steam enters through inlet 52 and is directed, as may be seen in FIG. 2, from the left to the right in the curved portion 58. The flow then continues to the right within the reduced diameter rim portion 28 flowing through second half U-shaped passageway 53 until it enters the L-shaped passageway 59. Within the second U-shaped passageway 53 the flow is diverted upwardly and then in L-shaped passageway 59 the flow is diverted to the rear. Discharge 54 of the L-shaped passageway communicates with the exterior of the full diameter rim portion and is located downstream on the turbine rim surface from the second U-shaped passageway which diverts the flow from an axial direction to the radially outward direction into the L-shaped passageway. It may be seen that discharge side wall 60 extends radially outwardly beyond reduced diameter rim portion 28 and partially defines discharge openings 54 and **54*a*. Discharge opening 54*a* is the discharge opening for the bucket located adjacent the primary bucket shown in FIG. 2. Flow divider 62 is shown extending perpendicular to the discharge side wall and defining the adjacent discharge areas. Nozzle support 22 as shown in FIG. 1 extends adjacent the rotor to provide a seal between the inlet and the outlet and to provide a seal extending parallel to discharge side wall 60 to form the last side of the discharge area 54**.

Figure 3:
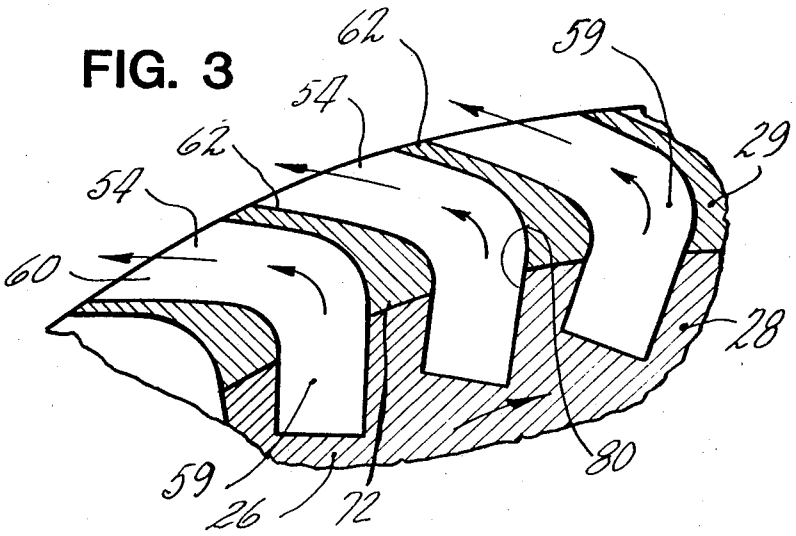
FIG. 3 is a partially cutaway sectional view taken along the line shown as III—III in FIG. 4.

Referring now to FIG. 3 there may be seen a partially, cutaway sectional view of FIG. 4 taken at line III—III. Rotor 26 is shown as is reduced diameter rim portion 28 and full diameter rim portion 29. The relative positioning of the two rim portions and the L-shaped passageway 59 may be observed.

The passageways shown in FIG. 3 are the L-shaped passageways for receiving flow from the second half U-shaped passageway and for directing the flow through discharge 54. Contour I referenced by numeral 80 and contour II referenced by the numeral 70 are the outer surfaces of the solid center portions 72 and are the surfaces which define the passageway. It may be also seen that flow divider 62 which is a continuation of center portion 72 separates adjacent L-shaped passageways and extends to the edge of full diameter rim portion 29. It is through this additional full diameter rim portion 29 that the discharge flow is guided in a manner not done in the previous application.

Referring now to FIG. 4, there may be seen a top view of rotor 26. Arrows are used to show the manner of flow through bucket 50 starting at inlet 52 and terminating at discharge 54. Arrows show the flow travels through first half U-shaped passageway 55 consisting of leg portion 57 and curved portion 58, through the second half U-shaped passageway and then flows into L-shaped passageway 59 flowing through discharge 54. The relative positioning of the discharge 54 for a specific bucket is additionally shown.

Solid center portions 72 consisting of the material not machined away when the buckets are formed include a smaller diameter curved surface referenced as contour II, item 70 and a larger diameter curved surface referenced as contour I, item 80. Inlet side wall 27 of the rotor is shown extending perpendicular to a position where the axis of the rotor would be. Leg portion 57 of the half U-shaped passage extends generally parallel to the inlet side wall and is connected to the curved portion which then diverts the inlet flow from the direction generally parallel to the side wall to a direction generally parallel with the axis of the rotor. From there within the second half U-shaped passageway the fluid flow is directed outwardly and within the L-shaped passageway is diverted at an angle to the radius of the rotor such that the flow is diverted toward the rear of the rotor from the whole diameter rim portion as the rotor spins.

Flow dividers 62 are shown dividing adjacent discharge areas 54 from adjacent buckets. Discharge side wall 60 is shown extending the full diameter of rim portion 29.

Figure 5A:
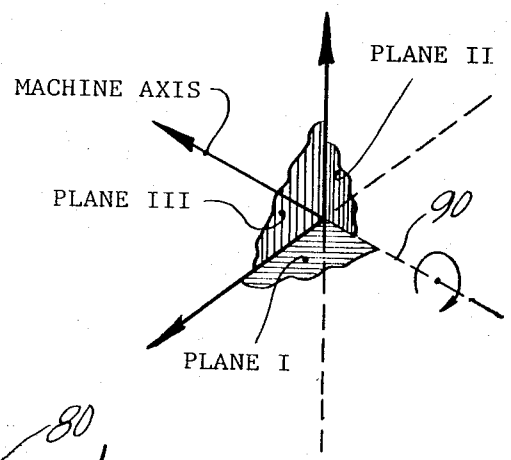
FIG. 5A is a plane orientation graph.
Figure 5:
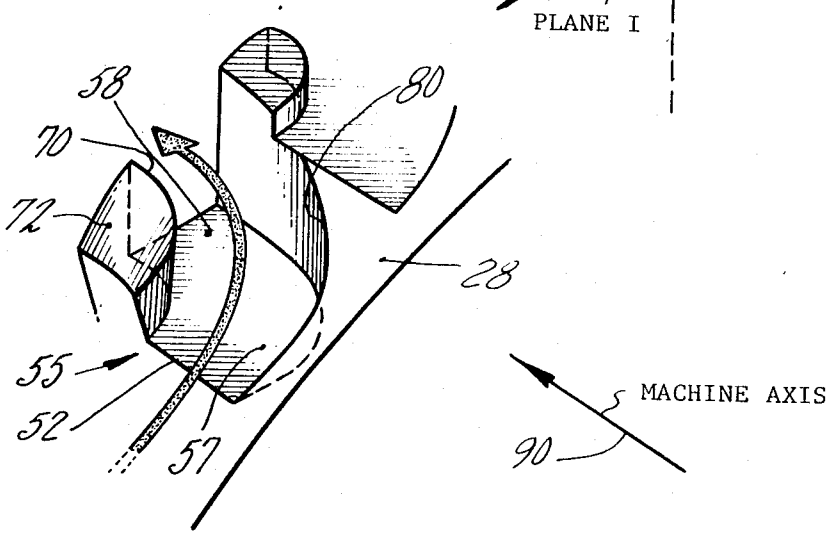
FIG. 5 is a cutaway perspective view of the inlet half of a single bucket.

FIG. 5 is a partially cutaway perspective view of the inlet half of the bucket. Therein it may be seen that the bucket as formed in the exterior surface of the reduced diameter rim portion 28 has inlet 52. A first half U-shaped passage 55 is defined including a leg portion 57 and a straight portion 58 within the inlet half portion of the bucket. Solid center portion 72 together with contours 70 and 80 define the passageway through the inlet half.

FIG. 5A is a plane orientation graph showing the location of machine axis 90 and planes I, II and III. Similar plane orientation graphs are provided in FIGS. 6A and 7A. Plane I is horizontal to and contains machine axis 90. Plane II also contains machine axis 90, however, it is perpendicular to plane I extending in general radial direction.

Plane III is perpendicular to machine axis 90 and perpendicular to planes II and I and also extends in a radial direction.

It may be seen that the direction of flow in the inlet half is changed from a direction perpendicular to the machine axis to a direction parallel to the machine axis as would be in plane II. Fluid enters in a plane parallel to plane I and the fluid then essentially turns a right angle in a plane parallel to plane I in the inlet half.

Figure 6A:
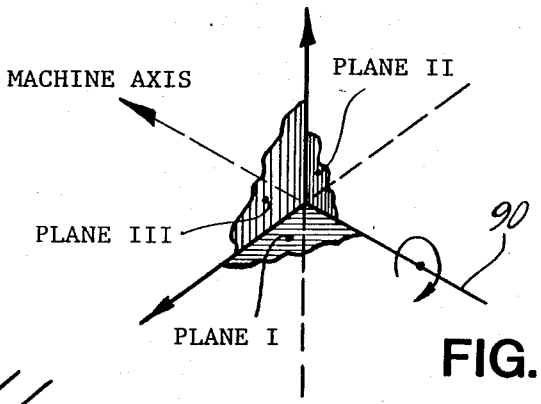
FIG. 6A is a plane orientation graph.
Figure 6:
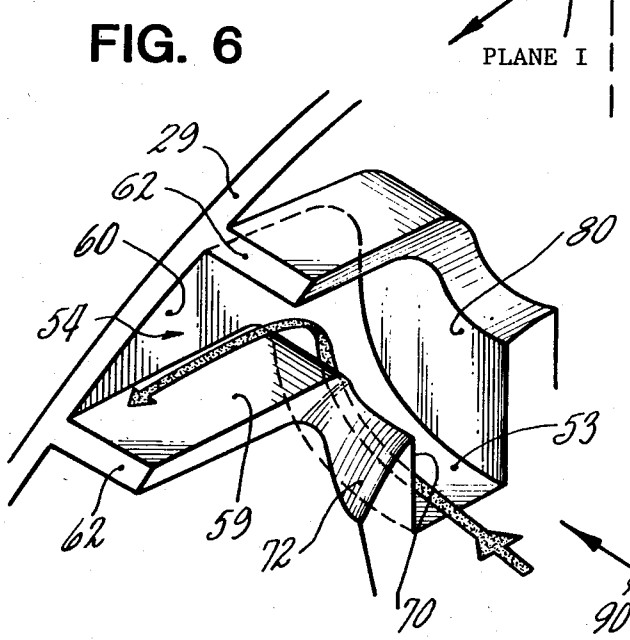
FIG. 6 is a cutaway perspective view of the outlet half of a single bucket.

Referring now to FIGS. 6 and 6A, the discharge half of the bucket may be seen. An arrow, which is drawn to show fluid flow through the bucket, has the fluid entering into the second half U-shaped passageway 53 and from there flowing to L-shaped passageway 59. Again, solid portion 72 and contours 70 and 80 define the fluid flow passageway. Additionally discharge side wall 60 defines a portion of the discharge area 54 from the full diameter rim portion 29. Flow divider 62 which is connected to and extends from solid center portion 72 is shown for dividing discharge areas from separate buckets.

As can be seen in FIG. 6, fluid enters the second half U-shaped portion in a plane parallel to plane II and then turns 90° upwardly within that plane. The fluid then turns at approximately a right angle to plane II in a plane parallel to plane III in the L-shaped passageway portion 59. Hence in the discharge half of the bucket as shown, the fluid makes a right angle turn in plane II and then it makes another turn into plane III which may be a right angle or may be in the area of 70° before being discharged from the bucket.

Figure 7A:
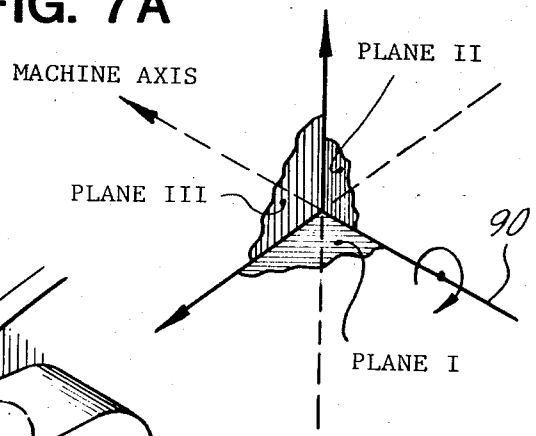
FIG. 7A is a plane orientation graph.
Figure 7:
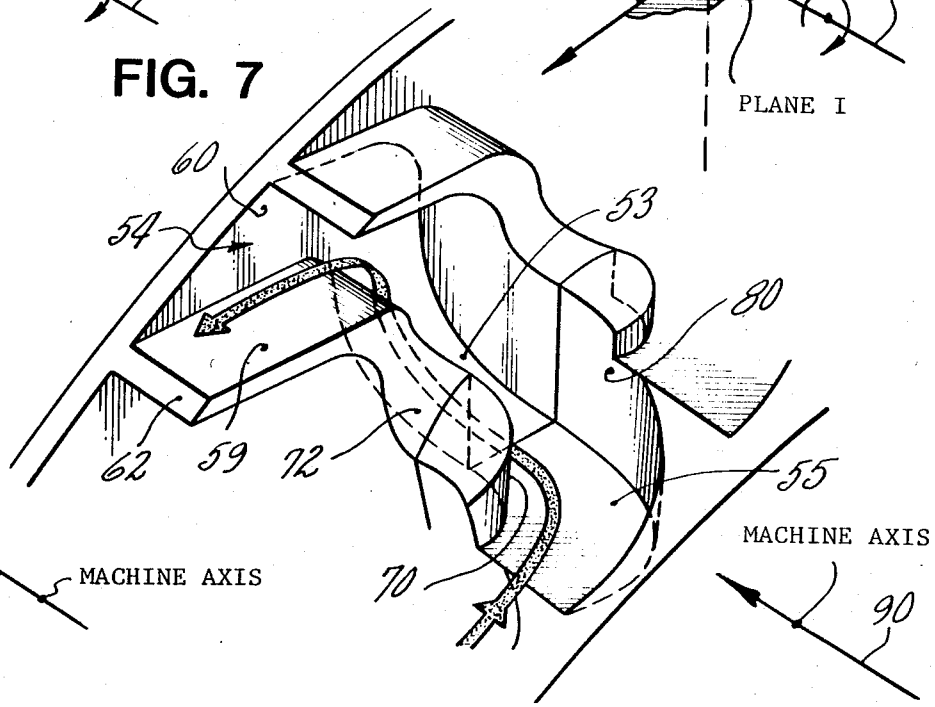
FIG. 7 is a perspective view of the bucket halves assembled.

FIGS. 7 and 7A reference an assembly drawing with the two halves of the buckets positioned together. Therein the interrelationships between the first half U-shaped passageway 55, the second half U-shaped passageway 53 and the L-shaped passageway 59 may be seen. Again, contours 70 and 80 and solid center portion 72 leading to flow divider 62 are referenced. As may be seen by the arrow indicating the flow, the flow enters in a plane parallel to plane I then turns 90° to a plane parallel to plane II. Flow then turns approximately 90° to a plane parallel to plane III to complete the flow through the bucket.

The above invention has been described with reference to a particular embodiment. It is to be understood by those skilled in the art that variations and modifications can be effected within the spirit and scope of the invention. The utilization of an additional larger diameter portion of a solid wheel turbine to obtain further flow guidance of the working fluid being discharged has been disclosed. It is this additional flow guidance that results in a substantial performance improvement of an erosion resistant solid wheel turbine.

I claim:

1. An impulse-type turbine having an inlet and an outlet with a flow path therebetween, a nozzle ring and a turbine wheel which comprises:

said turbine wheel having first and second circumferential rim portions of varying diameter each of a predetermined width with a plurality of uniformly spaced, overlapping buckets formed around said rim portions;

each of said buckets defining a first generally half U-shaped passageway having a leg portion, and a curved portion connected to the leg portion, a second generally half U-shaped portion connected to the curved portion, an L-shaped passageway extending from the second half U-shaped portion to the second rim portion and said leg portion extending to the first rim portion of the wheel;

a solid center portion defined by the passageways of the adjacent buckets; and labyrinth sealing means circumferentially extending about said rim portion and coacting with said center portions to provide a fluid seal between said leg portion which defines an inlet fluid path and the L-shaped portion which defines an outlet fluid path within the bucket.

2. The apparatus as set forth in claim 1 wherein the second circumferential rim portion has a diameter greater than the first circumferential rim portion and wherein the sealing means extends adjacent a side wall of the second circumferential rim portion to further define the outlet flow path of the bucket.

3. The apparatus as set forth in claim 1 wherein the solid center portion is at least partially defined by a first contour and a second contour which also defines walls of the passageways adjacent the solid center portion.

4. The apparatus as set forth in claim 1 wherein the L-shaped passageway extends generally radially outwardly and the second half U-shaped passageway extends generally axially.

5. The apparatus as set forth in claim 2 wherein the outlet flow path in cross section is generally rectangular at the second rim portion.

6. A turbine wheel comprising:

a solid wheel having a full diameter circumferential rim portion and a reduced diameter circumferential rim portion each of a predetermined width;

said wheel defining a plurality of uniformly spaced overlapping buckets formed within said wheel around the circumferential rim portions;

each of said buckets defining a first half U-shaped passageway having a leg portion connected to a curved portion with said curved portion having a diameter less than the width of the wheel and with said leg portion being generally parallel to a radially extending side surface of the wheel and extending to the reduced diameter rim portion of the wheel;

each of said buckets defining a second half U-shaped passageway connected to the curved portion; and each of said buckets defining a generally L-shaped passageway extending radially outward from the second half U-shaped passageway and terminating at the full diameter rim portion.

7. The apparatus as set forth in claim 6 and further comprising solid center portions located between buckets to partially define said passageways.

8. The apparatus as set forth in claim 6 wherein the L-shaped passageway extends from the second half U-shaped passageway located in a generally axially extending direction to an end terminating in a generally radially extending direction but at an angle to a radius of the wheel.

9. The apparatus as set forth in claim 6 wherein the L-shaped passageway is generally rectangular in cross section at the end terminating at the full diameter rim portion.

10. The apparatus as set forth in claim 9 wherein the discharge ends of adjacent L-shaped passageways are separated by flow dividers.

* * * * *

UNITED STATES PATENT AND TRADEMARK OFFICE

CERTIFICATE OF CORRECTION

PATENT NO. : 4,573,870

DATED : March 4, 1986

INVENTOR(S) : Zaher M. Moussa

It is certified that error appears in the above-identified patent and that said Letters Patent is hereby corrected as shown below:

Column 4, line 47: before "referenced" please change "Contour" to "contour" and delete the numeral "2".

Signed and Sealed this

Fourteenth Day of April, 1987

*Attest:*

DONALD J. QUIGG

*Attesting Officer*

*Commissioner of Patents and Trademarks*